US008748758B2

(12) United States Patent
Hoepfl et al.

(10) Patent No.: US 8,748,758 B2
(45) Date of Patent: Jun. 10, 2014

(54) ON-LOAD TAP CHANGER WITH ENERGY STORAGE MECHANISM

(75) Inventors: Klaus Hoepfl, Maxhuette-Haidhof (DE); Gregor Wilhelm, Regensburg (DE); Silke Wrede, Zeitlarn (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 177 days.

(21) Appl. No.: 13/380,684

(22) PCT Filed: Apr. 21, 2010

(86) PCT No.: PCT/EP2010/002429
§ 371 (c)(1),
(2), (4) Date: Jan. 12, 2012

(87) PCT Pub. No.: WO2011/009503
PCT Pub. Date: Jan. 27, 2011

(65) Prior Publication Data

US 2012/0103766 A1 May 3, 2012

(30) Foreign Application Priority Data

Jul. 24, 2009 (DE) ..... 10 2009 034 627

(51) Int. Cl.
*H01H 19/00* (2006.01)

(52) U.S. Cl.
USPC ..... 200/11 J

(58) Field of Classification Search
USPC ..... 200/11 J, 11 TC, 11 R, 6 R, 19.18, 200/19.19–19.22, 564, 568, 410, 431–435, 200/445, 458–462
See application file for complete search history.

(56) References Cited

U.S. PATENT DOCUMENTS

| | | | | |
|---|---|---|---|---|
| 3,553,395 | A * | 1/1971 | White | 200/18 |
| 3,798,395 | A * | 3/1974 | Norman et al. | 200/17 R |
| 5,123,291 | A | 6/1992 | Sonntaghbauer | |
| 2009/0000927 | A1 * | 1/2009 | Albrecht et al. | 200/11 TC |
| 2009/0165579 | A1 | 7/2009 | Johansson | |

FOREIGN PATENT DOCUMENTS

| | | |
|---|---|---|
| DE | 1227977 A | 11/1966 |
| DE | 2502810 A | 2/1976 |
| GB | 1341232 B | 12/1973 |

* cited by examiner

*Primary Examiner* — Edwin A. Leon
*Assistant Examiner* — Anthony R. Jimenez
(74) *Attorney, Agent, or Firm* — Andrew Wilford

(57) ABSTRACT

The invention relates to an on-load tap changer having an energy storage device, by means of which an output shaft is rotatable in spurts. According to the invention, in addition to the actual energy storage spring or the actual energy storage springs, at least one further spring is provided, which absorbs/releases energy after the activation of the energy storage mechanism whereby the torque curve can be optimised.

4 Claims, 3 Drawing Sheets

ON-LOAD TAP CHANGER WITH ENERGY STORAGE MECHANISM

CROSS REFERENCE TO RELATED APPLICATIONS

This application is the US-national stage of PCT application PCT/EP2010/002429 filed 21 Apr. 2010, published 27 Jan. 2011 as WO2011/009503, and claiming the priority of German patent application 102009034627.9 itself filed 24 Jul. 2009.

FIELD OF THE INVENTION

The invention relates to an on-load tap changer with a force accumulator for conversion of the continuous rotational movement of a drive shaft into an abrupt, rapid rotational movement of a driven shaft.

BACKGROUND OF THE INVENTION

Numerous force accumulators are already known that make possible abrupt rotation of the driven shaft in that one or more loaded force accumulator springs are abruptly released. Such force accumulator springs can be not only tension springs, but also compression springs. The principle is in that case always the same: a rotating drive shaft loads the spring or the springs up to a maximum point and thereafter these abruptly relax and thereby move the driven shaft. Such a force accumulator is known from DE 10 2006 008 338 (US 20090000927 and U.S. Pat. No. 8,119,939) of Albrecht. Obviously, in the case of the force accumulators of that kind—as a consequence also of the spring characteristic—the torque is greatest at the commencement of triggering of the springs loaded until then; it decreases until the end position. However, in certain cases this predetermined course of torque, which is dependent on the spring characteristic as well as the respective kinematics, and the speed, which results therefrom, of the driven shaft is not desired. This particularly is true in cases in which a greater number of switching elements or other components of the on-load tap changer are to be actuated in succession in a specific sequence.

In such instances of use a force accumulator is therefore desirable in which a selective adaptation of the movement of the driven shaft to the respective actual requirements is achieved.

It is already known from DE-AS 25 02 810 to provide for that purpose an auxiliary force accumulator along with a force accumulator of the kind described above. Apart from the actual force accumulator springs a further spring is then provided which on triggering of the force accumulator is loaded by a toggle joint. In that case a deceleration of the triggered force accumulator in the first part of the movement course is achieved by this additional spring being loaded, whereas toward the end of travel, if the actual force accumulator spring is already largely relaxed, the additional spring is similarly relaxed so that the spring forces are cumulative. This known solution was conceived at the time in order to slow down the triggering of the force accumulator specifically for the purpose of being able to switch an alternating current of 16⅔ Hz instead of the usual alternating current at a frequency of 50 Hz without the switchover process as a whole elapsing too rapidly. This known force accumulator is, moreover, of mechanically complicated construction, particularly due to the roller guidance and additional toggle lever arrangement for actuation of the auxiliary force accumulator springs. Moreover, it is exclusively provided for a force accumulator in which a rotation of the drive shaft is initially converted into a longitudinal movement in which the force accumulator springs are loaded and the rapid longitudinal movement after triggering thereof is converted back into rotation of the driven shaft. The known solution is not suitable for direct conversion of continuous into rapid rotation.

OBJECT OF THE INVENTION

The object of the invention is to provide an on-load tap changer with a force accumulator comprising, apart from the actual force accumulator spring or actual springs, further means which lead to selective adaptation of the rotation of the driven shaft.

SUMMARY OF THE INVENTION

A particular advantage of the invention is the simple construction thereof. Through an additional cam disk connected with the driven shaft a link is deflected whereby—depending on the respective instantaneous position of the cam disk—an additional spring is loaded or relaxed. The energy taken up or expended by the additional spring or additional springs decelerates or accelerates the rotation of the driven shaft selectively and appropriately to specific conditions, while the actual force accumulator spring relaxes.

BRIEF DESCRIPTION OF THE DRAWING

The invention will be explained in more detail by way of example in the following with reference to a drawing.

SPECIFIC DESCRIPTION OF THE INVENTION

The components designated by references 1 to 12 are already known from the Albrecht reference cited above, but for an understanding of the overall function are described once again here.

Figure 1:
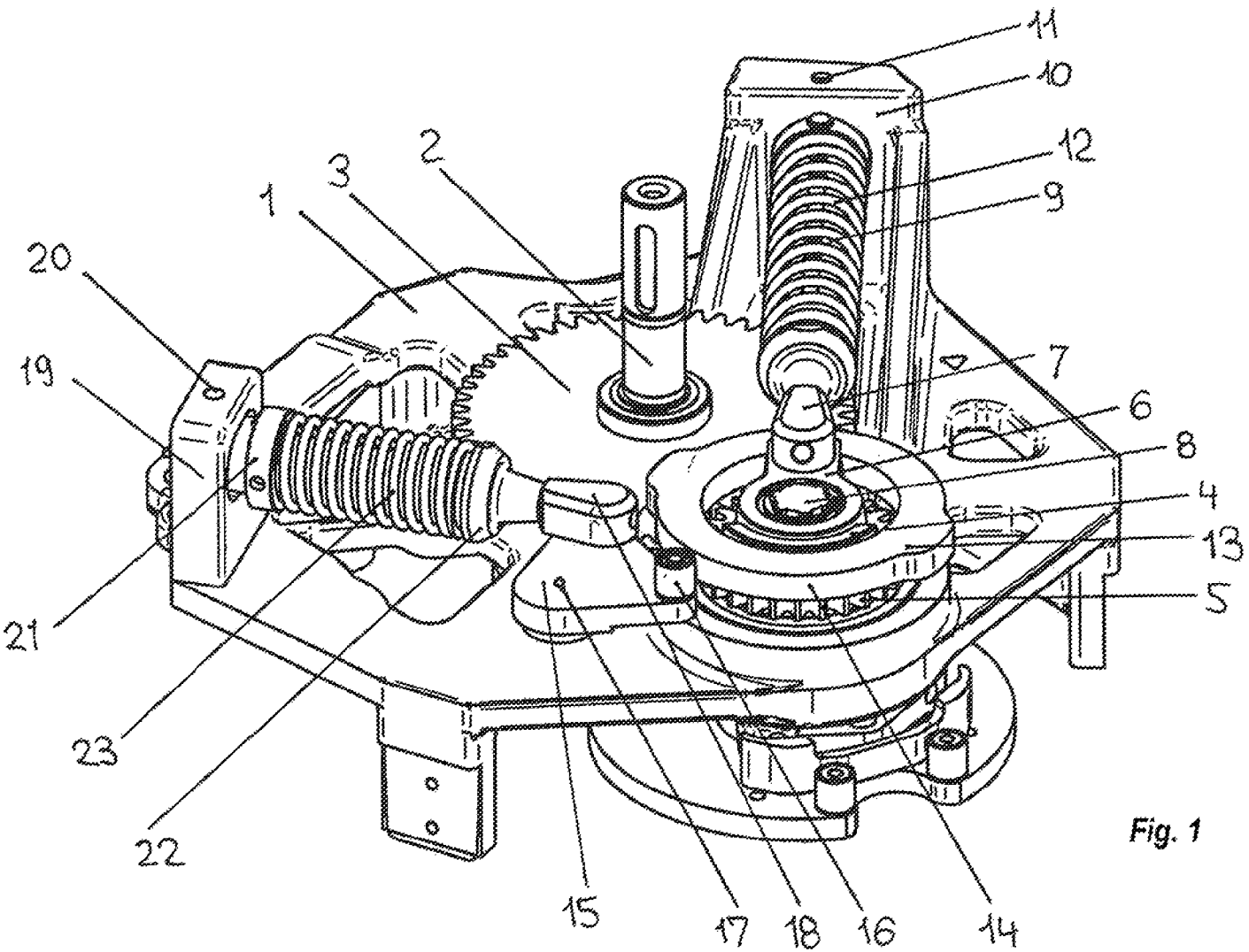
FIG. 1 shows a first on-load tap changer according to the invention with a force accumulator in a perspective schematic illustration.

A support plate 1 is shown in FIG. 1, on which the entire force accumulator and the transmission arrangement of the on-load tap changer are arranged. Also shown is a drive shaft 2 connected with a gear 3 to continuously drive it. Teeth 5 of the gear 3 in turn drive a drive element 4. The drive element 4 has symmetrical abutments which cooperate with a drive crank 6 that it can rotate. A head 7 on a pull rod is rotatably mounted on top of the drive crank 6. The drive crank 6 is fixed on a driven shaft 8 which vertically downward through the support plate 1. The components connected therewith for actuation of the contacts of the on-load tap changer are not shown here.

A spring tube 9 is provided around the pull rod. The spring tube 9 is pivoted at one end on a bearing block 10 and is horizontally pivotal on a vertical bearing pin 11. One or more compression springs 12 are provided concentrically around the spring tube 9 and/or therein. Only a single compression spring 12 is illustrated here.

The functioning of the force accumulator as described up to now is as follows:

At the start of each switching over, i.e. each actuation of the on-load tap changer, a motor drive rotates the gear 3 through the drive shaft 2. This rotation is transmitted by the teeth 5 to the drive element 4. According to the rotation direction, which depends on whether the next load switchover is to taken place in the direction of "higher" or "lower," one of the symmetrical abutments of the drive element 4 engages the drive crank 6 and rotates it. In that case the pull rod head 7 moves angularly, the pull rod is deflected, and the compression spring 12 is loaded. After one revolution of the drive crank 6 the pull rod has reached its new end setting; the compression spring 12 is at maximum compression or tension. After exceeding the dead center, rotation of the drive crank 6 and thus of the driven shaft 8 is forced to a rapid conclusion, since the compression spring 12 is abruptly released. This rapid rotation ultimately leads to a rapid switching over between individual contacts in the on-load tap changer.

According to the invention a cam disk 13 having an edge profile 14 is fixedly mounted on the drive crank 6. This profile 14 departs, as seen from above, from a circular shape. It is freely selectable within wide limits and can also be of directionally-dependent different construction. In addition, a link 15 is provided which has at one end thereof a roller 16 running on the edge profile 14 of the cam disk 13. The link 15 is pivotable about an axis 17 and is pivoted at its other end on another head 18 of a guide rod rotatably mounted in a further spring tube at its other end on a further bearing block 19 by a pivot pin 20. Both ends of the guide rod bear on abutments 21, 22 between which a further spring 23 is arranged. In addition, in this case one spring abutment 22 is fixed and the other spring abutment 21 is movable.

The operation of this auxiliary device is as follows:

After passing the dead center the drive crank 6, the driven shaft 8 begin to rapidly rotate, since, as explained, the compression spring 12 is abruptly released. The cam disk 13 also rotates together with the drive shaft 8. The roller 16 running on the profile 14 of the cam disk 13 pivots with the entire link 15. The spring 23 is thereby additionally loaded or released. It reduces or reinforces the force of the compression spring 12 and thus brakes or accelerates rotation of the cam disk 13 and thereby of the driven shaft 8. On further rotation of the driven shaft 8 the roller 16 then moves into another position in which the spring 23 relaxes and its previously stored force is now delivered in addition to the force—which is now becoming smaller—of the compression spring 12. Overall, a rapid movement, which is adapted to the current kinematic requirements, of the driven shaft 8 is thus achieved with maximally optimized torque.

Figure 2:
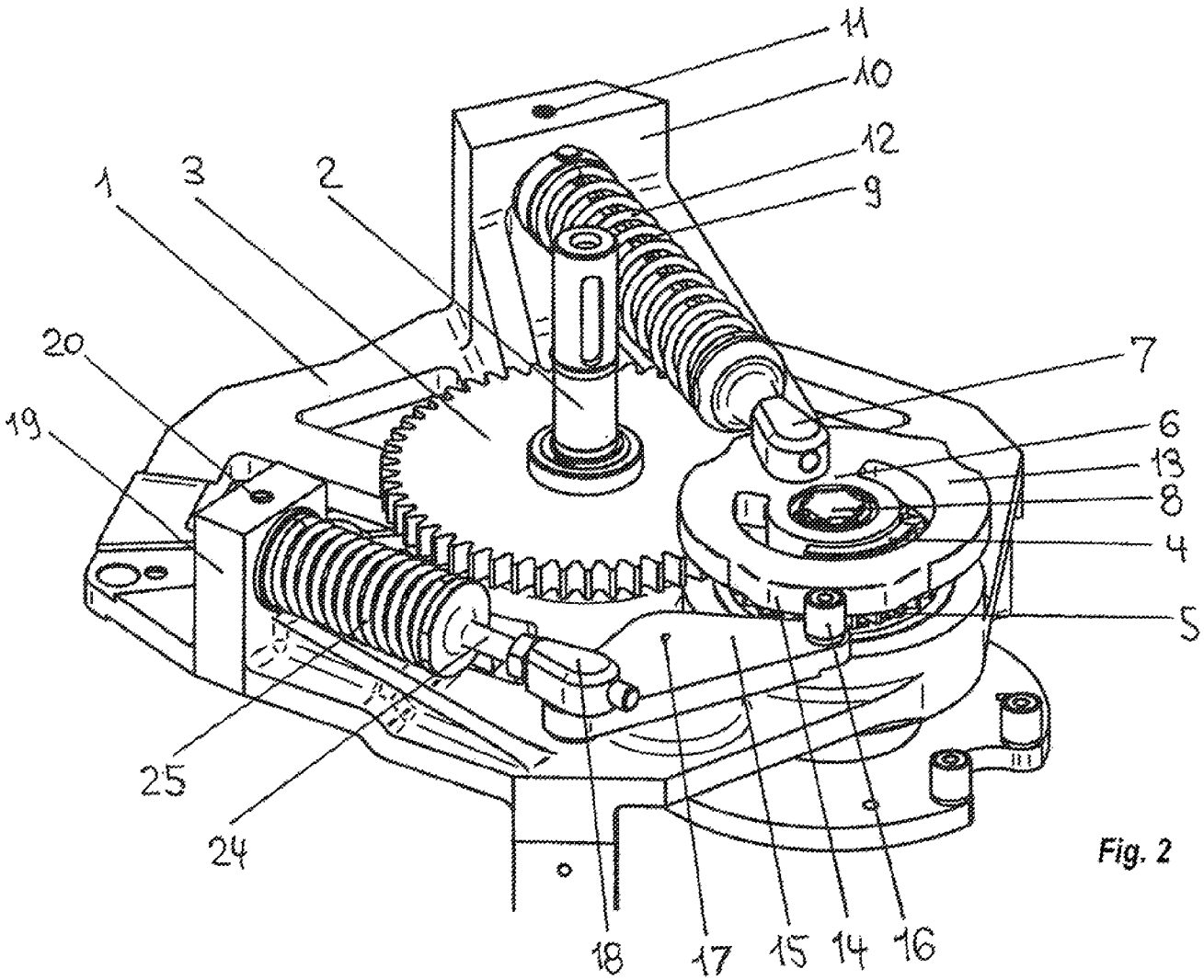
FIG. 2 shows a second embodiment of an on-load tap changer according to the invention and FIGS. 3*a* and 3*b* are schematic illustrations of different spring types within the scope of the invention.

FIG. 2 shows a further embodiment of the invention. In this regard, a link 15 is again pivotable about an axis 16 and again carries the rod head 18, which here is fixedly connected with a spring abutment 24. A spring 25 is provided between this abutment 24 and the bearing block 19. In this embodiment the direction of movement of the spring 25 is thus reversed relative to the embodiment illustrated in FIG. 1. The spring 25 is fixed to the bearing block 19 and is loaded by the spring abutment 24. The springs 23 and 25 of FIGS. 1 and 2 are compression springs.

Figure 3A:
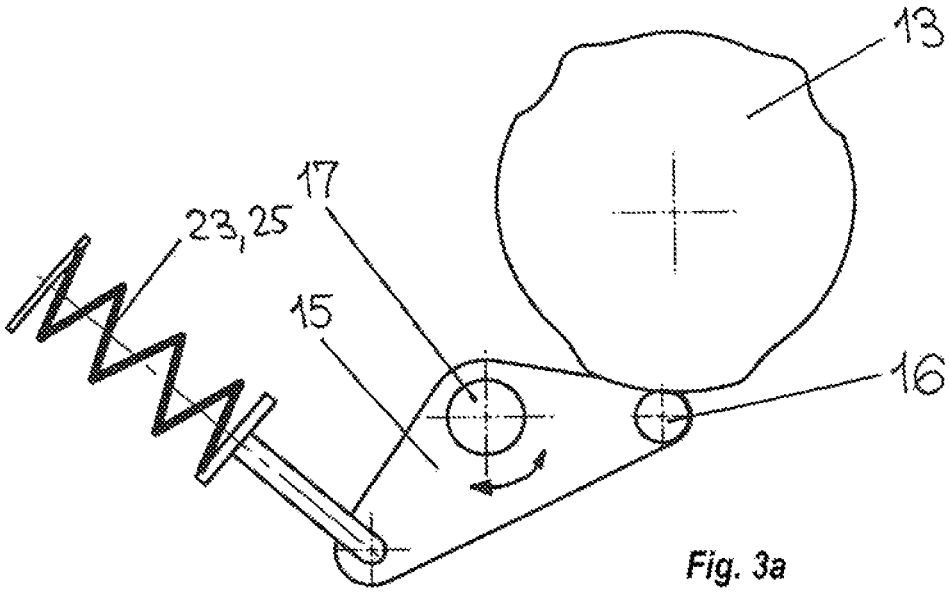
Figure 3B:
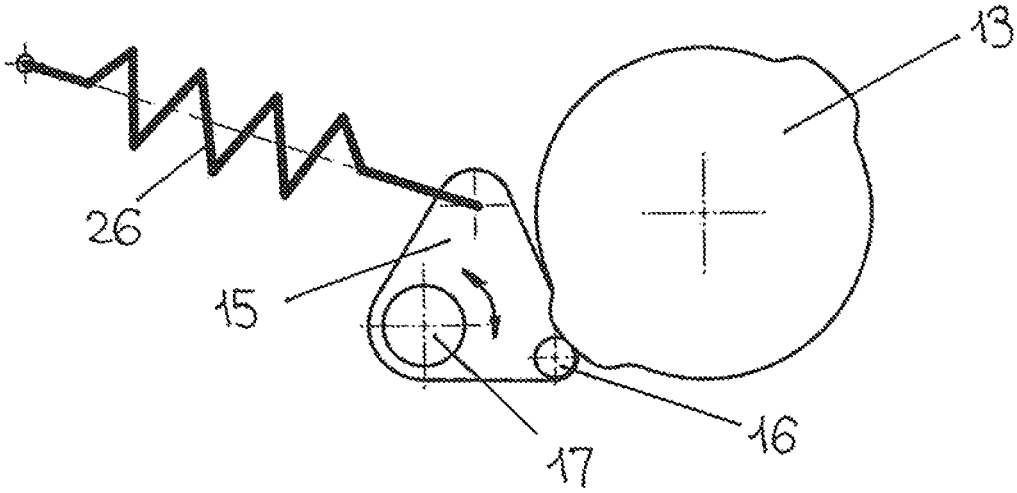

It is also possible within the scope of the invention to use tension springs in their place. This is schematically illustrated in FIG. 3. Different kinds of springs can be used solely by the physical arrangement of the axis 17 of rotation of the link 15 and the position of the roller 17 that runs on the profile 14 of the cam disk 13. FIG. 3*b* shows a tension spring 26 which can be deflected. FIG. 3*a* shows a compression spring 23, 25 which can be compressed. Also conceivable within the scope of the invention are concentric arrangements of two or more such springs 23, 25 or 26.

Moreover, an embodiment as a linear guide is also possible within the scope of the invention.

Regardless of the actual construction of the force accumulator the essence of the invention consists generally in that a driven shaft 8 is abruptly rotated by a force accumulator spring after triggering thereof and fastened to this driven shaft 7 is a cam disk 13 with an edge profile 14 loads or unloads a further spring 23, 25 or 26 appropriately to requirements and thus the speed of the rotation is selectively influenced by addition or absorption of force. At the end of the abrupt movement excess movement energy can be absorbed by stressing the further spring 23, 25 or 26 and a smooth braking can thereby be achieved in an advantageous manner. As already explained, the absorption of energy is possible through either the expansion of a tension spring 26 or the compression of a compression spring 23, 25.

The invention claimed is:

1. In combination with an on-load tap changer having a rotatable drive shaft:

a driven shaft;

a driven element movable by the driven shaft between end positions flanking an intermediate toggle position and rotationally couplable to the drive shaft;

a first spring braced against the driven element and loaded on movement of the driven shaft from one of the end positions toward the intermediate toggle position, whereby after movement past the toggle position the driven element is forced by the first spring into the other of the end positions and the driven element rotates the drive shaft;

a cam fixed on the drive shaft and having a noncircular edge;

a link carrying a roller; and a second spring braced against the link and urging the roller radially against the edge, whereby forces applied by the second spring and the shape of the cam edge affect the rotation rate of the drive shaft on travel of the driven element away from the intermediate toggle position.

2. The combination defined in claim 1, further comprising:

a support plate against which the first and second springs are braced.

3. The combination defined in claim 2, wherein each spring has one end pivoted on the support plate.

4. The combination defined in claim 3, wherein the link is a lever pivoted on the support plate and having one arm carrying the roller and an other arm on which the second spring is pivoted.

* * * * *